US007269916B2

(12) United States Patent
Biancucci et al.

(10) Patent No.: US 7,269,916 B2
(45) Date of Patent: Sep. 18, 2007

(54) SHOE SOLE PROVIDED WITH RETRACTABLE ANTI-SLIPPING MEANS

(75) Inventors: Demetrio Biancucci, Civitanova Marche (IT); Alfredo Brasca, Civitanova Marche (IT)

(73) Assignee: AL.PI. S.r.L., Civitanova Marche (MC) (IT)

( * ) Notice: Subject to any disclaimer, the term of this patent is extended or adjusted under 35 U.S.C. 154(b) by 84 days.

(21) Appl. No.: 10/531,869

(22) PCT Filed: Nov. 4, 2003

(86) PCT No.: PCT/IT03/00714

§ 371 (c)(1),
(2), (4) Date: Apr. 19, 2005

(87) PCT Pub. No.: WO2004/041016

PCT Pub. Date: May 21, 2004

(65) Prior Publication Data

US 2006/0162188 A1 Jul. 27, 2006

(30) Foreign Application Priority Data

Nov. 5, 2002 (IT) ..... RM2002A0556

(51) Int. Cl.
*A43C 15/00* (2006.01)

(52) U.S. Cl. ..... 36/61

(58) Field of Classification Search ..... 36/61, 36/134

See application file for complete search history.

(56) References Cited

U.S. PATENT DOCUMENTS

| | | | | |
|---|---|---|---|---|
| 286,240 | A * | 10/1883 | Treat | 36/61 |
| 309,747 | A | 12/1884 | Torrence | |
| 997,055 | A | 7/1911 | Gilowitz | |
| 2,920,403 | A * | 1/1960 | Etoile | 36/61 |
| 4,745,692 | A | 5/1988 | Liao | |
| 6,360,455 | B1 | 3/2002 | Seo | |

FOREIGN PATENT DOCUMENTS

| | | |
|---|---|---|
| FR | 2 785 508 | 5/2000 |
| WO | WO 00 04803 | 2/2000 |
| WO | WO0004803 A1 * | 2/2000 |

* cited by examiner

*Primary Examiner*—Ted Kavanaugh
(74) *Attorney, Agent, or Firm*—Young & Thompson

(57) ABSTRACT

A sole (6) for anti-slipping shoes of the type including foldaway anti-slipping elements (12) arranged in the face of the sole that will come in touch with the ground, characterized in that the anti-slipping elements to increase the adherence to the ground are secured to rigid or semirigid supporting members (10) that are hinged to the sole so as to be lifted from the same by rotation like a flag by at least 180° with respect to a symmetry axis other than the axis of hinge/lifting from the shoe sole and not parallel thereto. Each the supporting member being housed during the use of the sole in its own single recess or groove (8) arranged in the sole portions.

2 Claims, 3 Drawing Sheets

SHOE SOLE PROVIDED WITH RETRACTABLE ANTI-SLIPPING MEANS

This application is a 371 of PCT/IT03/00714 filed Nov. 4, 2003.

The present invention relates to the footwear industry and more specifically concerns the manufacturing of soles for shoes to be used where the ground is particularly slippery, for example frozen, snowy or muddy ground.

It is well known that under such circumstances anyone can hardly stand. The danger of slipping can obviously be avoided by resorting to the known hobnail shoes or shoes provided with particular high-adherence soles which, however, are technical shoes with precise characteristics of weight and strength and not compatible with the normal use of shoes.

The resort to hobnail shoes could once be avoided by applying sealskins or the like to shoes to prevent the sole from touching the frozen ground. Based on the same principle are rubber sheaths available on the market today which have to be secured to shoes in a removable manner and carry a number of nails or hooks on the face directed to ground.

Such solution, however, has the serious drawback of forcing the user, whenever he or she enters a habitation or leaves the road to enter a building, to remove the sheathes from the shoes to avoid that its nails or hooks damage floors by somehow or other. It is self-evident that such operation, uncomfortable in itself, requires that user must take away the sheathes with him or her waiting for put them on again.

To overcome such problems, Italian Patent 1299575 in the name of the same Applicants discloses soles provided with nails or hooks which are secured to suitable supporting members that can be folded by 180° and have ends hinged directly to the sole so that they can be rotated from extracted to retracted positions to be housed into suitable specular grooves reproducing their shapes and preferably formed in the thickness of the tread.

Even if such known soles provide the desired increase in the adherence, they are not able to satisfy some specific requirements of the market.

A first limit of such known devices is that such folding hobnail supporting members located both in the sole and heel portions must each take up a lower room than half the room taken up by the corresponding area of shoe sole and heel portions, respectively. This results from that each supporting member is accommodated in one of the two specular grooves associated thereto both in its position of use (extracted hobnails) and rest position (retracted hobnails). Such specular grooves have to be arranged of course in the corresponding area of the shoe sole (sole or heel portions) so that the extension of the hobnail supporting members is limited, especially in the heel portion both for reasons of size and not to weaken too much the structure of the whole sole.

A second limit is that the specular grooves that are not occupied by the corresponding folding hobnail supporting member can easily collect dirt, mould, mud, etc., which requires that the user cleans perfectly the obstructed grooves before folding the corresponding hobnail supporting members to be put inside them.

A first object of the present invention is to provide a shoe sole provided with foldaway means to increase the adherence to the ground and arranged in the tread of the sole and heel portions so as to take up all of the available surface of the sole and heel portions, respectively.

A second object of the invention is to provide a shoe sole of the above-mentioned type, wherein only one print or housing groove to be used in both modes of application is provided for each such means to increase the adherence to the ground.

This has been accomplished according to the invention by providing a shoe sole provided at the face in touch with the ground with anti-slipping means to increase the adherence, such as a plurality of solid hooks or nails or a coating of high-adherence rubber material, which means are not fixed to such sole but are secured so that they can pass from an extracted position in touch with the ground to a concealed position where they do not interfere with the roadway. According to the invention, such means to increase the adherence to the ground are secured to suitable solid supporting members that are hinged to the sole so as to be lifted from the same by rotation by at least 180° with respect to a symmetry axis other than the axis of hinge/lifting from the shoe sole and not parallel thereto. Each such supporting member at the heel and/or at the sole is housed in its own single recess or groove arranged in a corresponding position in the heel and sole portions, respectively.

In a preferred embodiment the pivoting, folding supporting members have two opposite faces to one of which such means to increase the adherence are secured. In a first position, the position of use, the nails or the coating of rubber material protrude from the sole by as much as it is enough to guarantee the grip to the ground. In the second position, the rest position, the nails or the rubber coating are directed to the shoe sole and are housed within suitable recesses formed in corresponding positions in the bottom of the print receiving the supporting members so that the continuity of the shoe sole is restored without any protrusion.

Further features and advantages of the invention will be more readily apparent from the following detailed description with reference to the accompanying drawings that show by way of a not limited example a preferred embodiment thereof.

Figure 1:
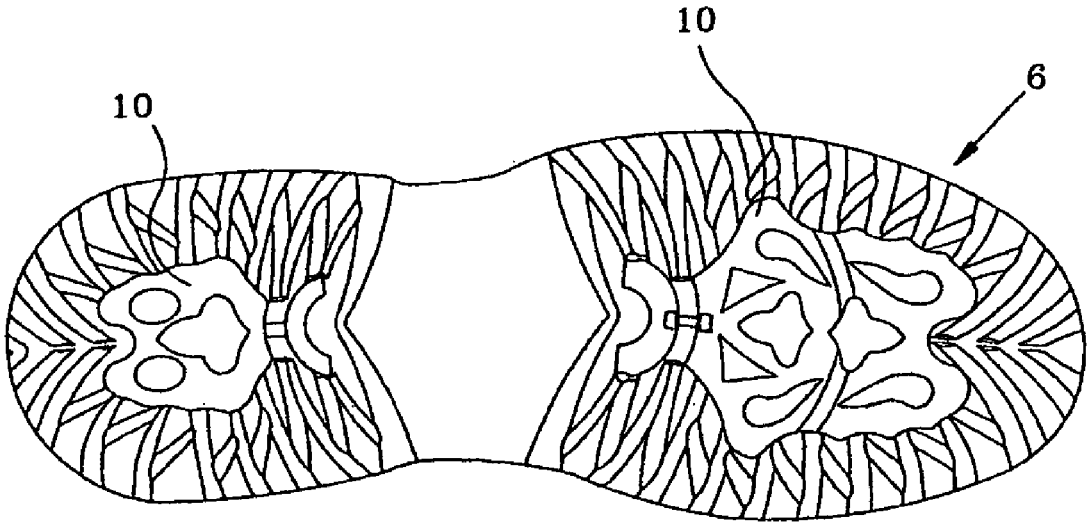
FIG. 1 is a front view of the sole in the usual configuration.
Figure 4:
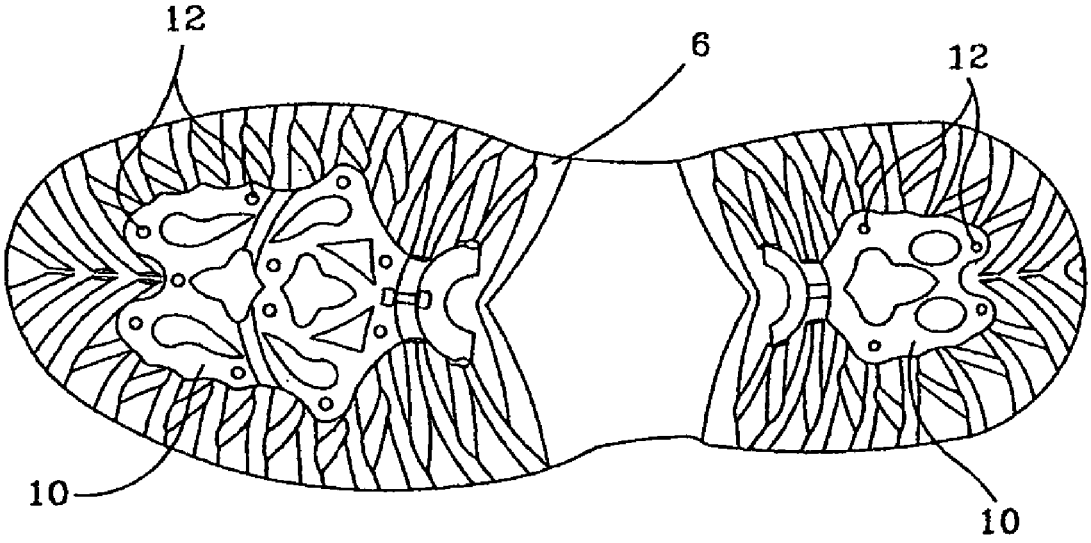
Figure 2:
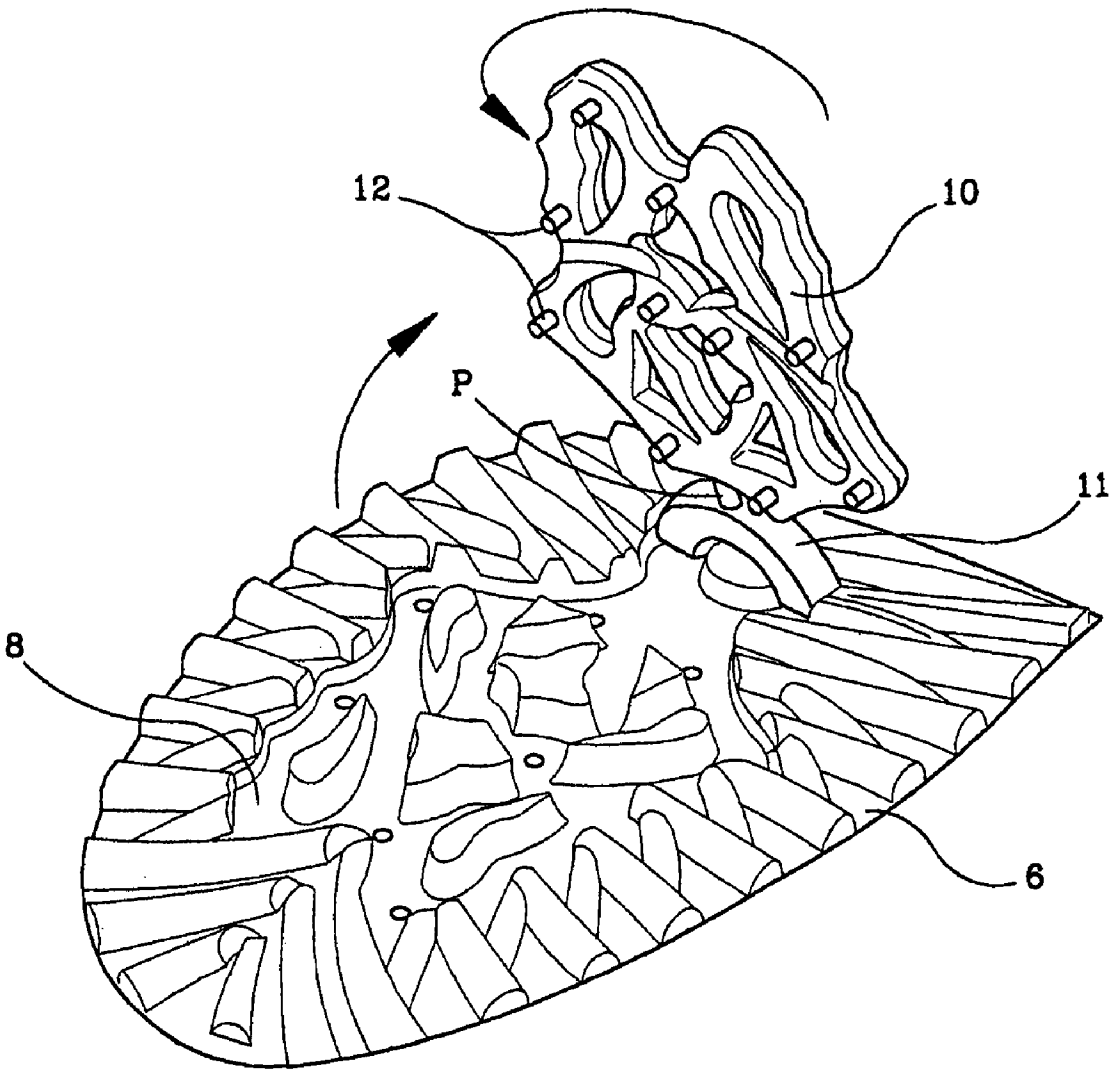
FIG. 2 is a perspective view of the invention showing the supporting member for the adherence increasing means while it is being lifted from the shoe sole by rotation like a flag to be then rotated by 180° about a symmetry axis so as to direct to the outside the face to which the nails or the high-adherence rubber material is secured.
Figure 3:
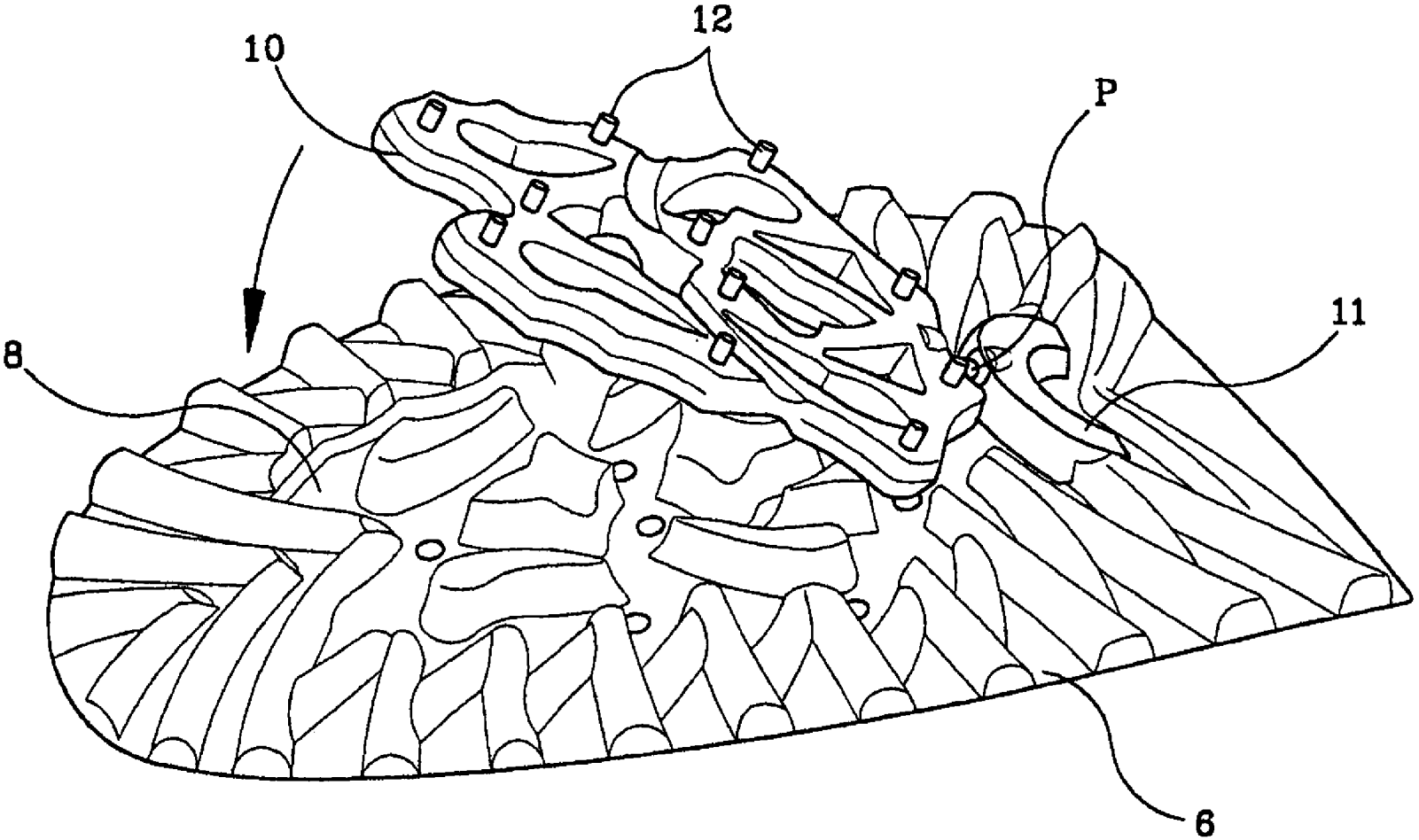
FIG. 3 is a perspective view similar to the preceding figure showing the invention while such supporting member is being brought back to its initial position within the shoe sole, with the nails or the high-adherence rubber material being directed and protruding to the outside.

FIG. 4, similar to FIG. 1, shows the shoe sole disclosed in configuration of use for a ground with poor adherence.

With reference to the figures, the anti-slipping shoe sole 6 according to the invention with foldaway hooks 12 (or areas of high-adherence rubber material) has at least a groove or print 8 on the face which will come in touch with the roadway, such print 8 being able to receive with a clearance rigid or semirigid supporting members 10 that can be shaped in most different ways, as shown, but are characterized in that they have at least a symmetry axis. Such supporting members 10 carry a plurality of nails or areas of high-adherence material 12 which are preferably of semirigid plastic material. Nails or hooks 12 are uniformly distributed all over the length thereof.

According to a peculiar feature of the invention, such supporting members 10 are hinged at one end of such symmetry axis about a hinge member 11 secured in a known manner to the shoe sole and having the rotation axis parallel thereto. In other words, the rotation to lift supporting means 10 is caused by such hinge member 11, while the 180° folding rotation about its own symmetry axis occurs about pin P which connects such supporting means pivotably to the hinge member 11 that rotates with respect to sole 6.

It should be appreciated from the foregoing the practicality of the anti-slipping device of the present invention: the user has only to perform simple actions of lifting, rotating, lowering supporting members 10 of nails 12 to pass from a smooth sole to be used in the interior to a hobnail sole for slippery surfaces.

In the illustrated embodiment, such hinge member 11 consists of a small arc having ends hinged to sole 6 and to which a pin P is secured. Such pin has its longitudinal axis coincident with a symmetry axis of supporting member 10 which is pivotable about pin P secured to such arc 11.

As already mentioned, only one print or groove 8 able to receive supporting means 10 of nails or areas of high-adherence material 12 in both configurations of use has the great advantage to make print 8 free of obstructions or fillings by mould or other materials which enter the recesses of the tread, as well known.

A preferred embodiment of the invention has been described above. It is evident, however, that a number of modifications can be made by those skilled in the art without departing from the scope of the invention as defined in the appended claims. For example, instead of being hinged with respect to the sole that receives them, supporting members 10 of nails or hooks 12 can be snap fitted so as to be removed and inserted again after a rotation by 180° to make it visible either the face provided with nails or the smooth face.

The invention claimd is:

1. A sole for anti-slipping shoes having a tread comprised by a plurality of projections on an underside of the sole, anti-slipping means to increase adherence to the ground, said anti-slipping means comprising a plate having projections on only one side thereof, means mounting said plate on said sole for vertical swinging movement about a first axis extending transversely of the sole and for rotation about a second axis transverse to said first axis between two rotated positions 180° apart, said plate having a plurality of openings therein each adapted to receive one of said projections on the underside of the sole in either said rotated position of said plate, whereby said plate may be swung away from the sole, rotated 180° and returned to the sole, with said projections on the underside of the sole filling each of said holes in either of the two positions of the plate against the sole.

2. Sole according to claim 1, wherein said plate is hinged to the sole by an arcuate member having ends hingedly connected to the sole along said transverse axis, and wherein said plate is hinged to said arcuate member at a summit of said arcuate member between said ends.

* * * * *